United States Patent [19]

Ishikawa et al.

[11] Patent Number: 4,599,674

[45] Date of Patent: Jul. 8, 1986

[54] CIRCUIT FOR DRIVING SOLENOID

[75] Inventors: Masataka Ishikawa; Masami Kondo, both of Higashimatsuyama, Japan

[73] Assignee: Diesel Kiki Co., Ltd., Japan

[21] Appl. No.: 706,477

[22] Filed: Feb. 28, 1985

[30] Foreign Application Priority Data

Feb. 28, 1984 [JP] Japan ..... 59-035342

[51] Int. Cl.[4] ..... H01H 47/32

[52] U.S. Cl. ..... 361/154; 361/190

[58] Field of Search ..... 361/152, 154, 159, 189, 361/190

[56] References Cited

U.S. PATENT DOCUMENTS 3,982,505 9/1976 Rivere ..... 361/154 X 4,224,654 9/1980 Goldthorp et al. ..... 361/152

4,399,483 8/1983 Phelan ..... 361/154

*Primary Examiner*—Michael L. Gellner

*Attorney, Agent, or Firm*—Guy W. Shoup

[57] ABSTRACT

A solenoid driving circuit for supplying an exciting current whose level suddenly increases at the beginning of the flow of the current has a voltage inducing circuit for providing a pulse-like current component which suddenly increases at the beginning of the flow of the exciting current, a unidirectional element for supplying the pulse-like current component to the solenoid, a voltage limiting element for limiting the level of the pulse-like current component and applying a d.c. power to the solenoid, and a circuit for providing a stand-by current and the holding current to the solenoid, whereby the solenoid is effectively supplied with sufficient energy for driving it at high speed and the power required for maintaining the operation of the solenoid is reduced.

10 Claims, 6 Drawing Figures

FIG. 1
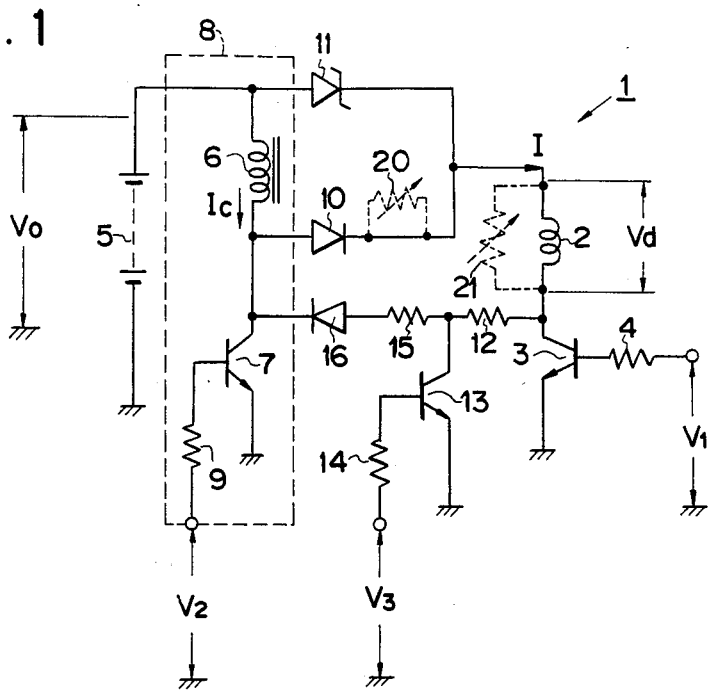
FIG. 2A
FIG. 2B
FIG. 2C
FIG. 2D
FID. 2E
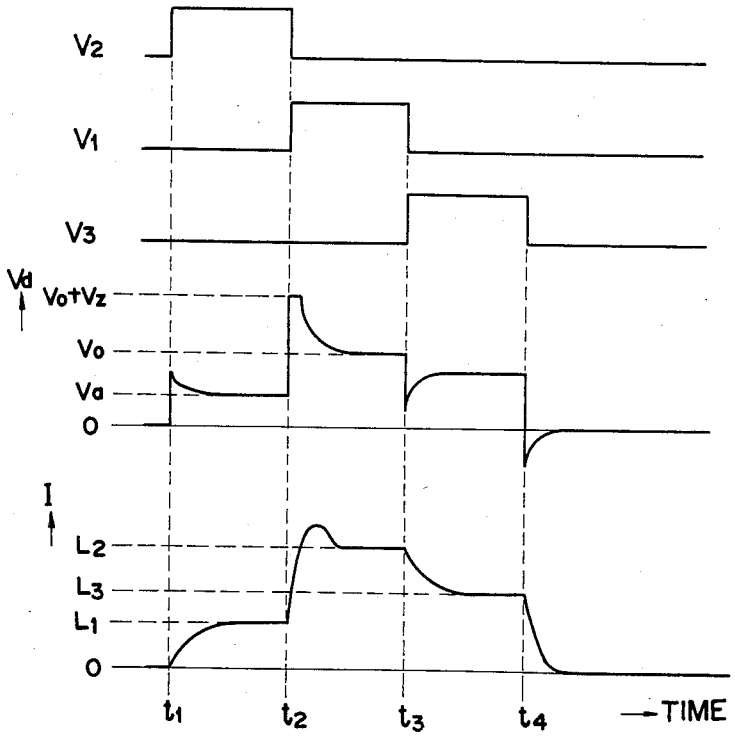

CIRCUIT FOR DRIVING SOLENOID

BACKGROUND OF THE INVENTION

1. Field of the Invention

The present invention relates to a circuit for driving a solenoid, and more particularly to a solenoid driving circuit for driving solenoids used in solenoid valves, solenoid relays and the like at high speed.

2. Description of the Prior Art

For high speed operation of solenoids, there have been proposed various kinds of circuits for supplying a sudden counterelectromotive force to drive the solenoid by cutting off current flowing through a choke coil.

As such a circuit, there is disclosed for example in Japanese Patent Public Disclosure No. 61106/81 an electromagnet driving circuit in which a series circuit of a choke coil and a first switch is connected in parallel with a d.c. power source, one end of the solenoid to be driven is connected with both ends of the choke coil through diodes, and the other end of the solenoid is connected through a switch with one end portion of the d.c. power source.

In this electromagnet driving circuit, the first switch is normally closed so that a steady current is supplied to the solenoid from the d.c. power source through the choke coil, and the switch is normally open. In this condition, when the switch is closed at the same time the first switch is opened, a large counterelectromotive force due to electromagnetic induction is produced in the choke coil. The voltage due to the counterelectromotive force is superposed on the voltage of the d.c. power source to make it possible to provide a suddenly standing-up exciting current to the solenoid.

However, the waveform of the exciting voltage supplied to the solenoid by the conventional driving circuit is extremely sharp, has a large peak value, and is extremely narrow in width. Therefore, with respect to other nearby electronic equipment, it constitutes a high level noise source, and the efficiency of the circuit is low since most of the energy is used for the production of noise. The efficiency of the circuit is also low since the exciting energy is provided only for a short time, and the service life of the switches is short since they are subject to the voltage with an extremely large peak value. Also, when semiconductor switching elements are used for the switches, it is necessary to use expensive elements which can withstand very high voltage since a voltage with an extremely large peak value is produced in this circuit.

Furthermore, in Japanese Patent Application Disclosure No. 109864/80, there is disclosed a circuit in which a current feedback is provided to the solenoid to be driven for the purpose of improving the response characteristics. However, this circuit has a disadvantage in that a complex circuit structure becomes necessary to provide the current feedback.

SUMMARY OF THE INVENTION

It is therefore an object of the present invention to provide an improved solenoid driving circuit which is capable of eliminating these drawbacks in the conventional circuit.

It is another object of the present invention to provide a solenoid driving circuit which is capable of effectively supplying the counterelectromotive force produced in the choke coil to the solenoid to be driven and remarkably reducing the production of electromagnetic noise.

It is still another object of the present invention to provide a solenoid driving circuit which is capable of reducing the amount of electric power necessary for driving a solenoid.

According to the present invention, in a solenoid driving circuit for providing an exciting current which suddenly stands up to a solenoid in order to operate the solenoid at high speed, the solenoid driving circuit has a d.c. power source, a first switch connected in series with the solenoid for passing or cutting off the exciting current supplied to the solenoid, a series circuit for producing a counterelectromotive force, the series circuit being connected to the d.c. power source and being composed of a choke coil and a second switch which is switched from its ON state to its OFF state when the first switch is switched from its OFF state to its ON state, a unidirectional element connected between one end of the choke coil and the solenoid in order to apply to the solenoid a counterelectromotive force produced in the choke coil, a voltage limiting element for limiting the level of the transient voltage applied to the solenoid through the unidirectional element and for applying the voltage of the d.c. power source to said solenoid coil, the voltage limiting element being connected between the solenoid and the d.c. power source, a circuit for providing a standby current with a first level to the solenoid when the second switch is ON, and means for providing a maintaining current with a second level less than that of the exciting current to the solenoid after the solenoid is energized in response to the operation of the first switch.

With this structure, since the peak value of the transient voltage produced by the series circuit is limited by a voltage limiting element such as a zener diode, the occurrence of electromagnetic noise can be remarkably reduced and the transient voltage can be maintained for a longer period than in conventional circuits of this type. Therefore, it becomes possible to provide sufficient energy for making the leading edge of the exciting current sharp at the start of the solenoid driving operation. This, plus the fact that stand-by current is provided to the solenoid to maintain it at a desired pre-energization state just before it starts to operate, makes it possible to realize extremely high speed operation of the solenoid.

Furthermore, since the operating state of the solenoid can be maintained with less maintaining current after the solenoid has been driven, the consumption of power can be reduced and the amount of the heat produced due to the exciting current can be suppressed. As a result, the size of the solenoid can be reduced.

The invention will be better understood and the other objects and advantages thereof will be more apparent from the following detailed description of a preferred embodiment with reference to the accompanying drawings.

BRIEF DESCRIPTION OF THE DRAWINGS

FIG. 1 is a circuit diagram of an embodiment of a solenoid driving circuit of the present invention; and FIGS. 2A to 2E are the waveforms of signals at respective points of the circuit of FIG. 1.

DESCRIPTION OF THE PREFERRED EMBODIMENTS

FIG. 1 shows an embodiment of a solenoid driving circuit of the present invention. The solenoid driving circuit 1 has a transistor 3 as a switching element for ON/OFF controlling an exciting current I flowing through a solenoid coil 2 and a control voltage $V_1$ is applied through a resistor 4 to the base of the transistor 3. The solenoid coil 2 may be the exciting coil of a solenoid valve, a solenoid relay or the like.

A voltage inducing circuit 8 for generating a counterelectromotive force is formed by connecting a choke coil 6 in series with a switching transistor 7 and the voltage inducing circuit 8 is connected in parallel with a d.c. power source 5 for supplying an exciting current to the solenoid coil 2. The transistor 7 is controlled so as to be turned ON or OFF in accordance with the level of a control voltage $V_2$ which is applied through a resistor 9 to the base thereof. The control voltages $V_1$ and $V_2$ are produced by a control circuit (not shown) so as to turn OFF the transistor 7 when the transistor 3 is turned ON. Consequently, in response to the control voltages $V_1$ and $V_2$, the transistor 7 is turned ON when the transistor 3 is turned OFF.

A steady current flows through the choke coil 6 when the transistor 7 is ON, and a counterelectromotive force due to electromagnet induction is produced in the choke coil 6 when the transistor 7 is turned OFF at the same time the transistor 3 is turned ON.

To apply the terminal voltage $V_0$ of the d.c. power source 5 and the voltage which is momentarily produced by the counterelectromotive force developed across the choke coil 6 to the solenoid coil 2, as shown in FIG. 1, a zener diode 11 is connected between the positive terminal of the d.c. power source 5 and the solenoid coil 2, and a diode 10 is connected between the collector of the transistor 7 and the solenoid coil 2. As a result, the terminal voltage $V_0$ is supplied through the zener diode 11 to the one end of the solenoid coil 2. Then, when the counterelectromotive force is developed across the choke coil 6, the resulting transient voltage is supplied through the diode 10 to the same end of the solenoid coil 2. In this case, the zener diode 11 also acts as a voltage limiting element for maintaining the level of the voltage developed due to the counterelectromotive force below a predetermined level, so that a voltage with a limited peak value voltage developed due to the counterelectromotive force can effectively be applied to the solenoid coil 2.

In order to provide a maintaining current of a lower level to the solenoid 2 for maintaining the energized state of the solenoid 2 after it is initially energized, a series circuit of a current limiting resistor 12 and a transistor 13 is provided between the collector of the transistor 3 and ground. The base of the transistor 13 receives a control voltage $V_3$ through a resistor 14. When the transistor 13 is turned ON by the application of the control voltage $V_3$, a path is formed for passing the current flowing through the solenoid 2 through the resistor 12 to ground.

Furthermore, the collector of the transistor 13 is connected through a resistor 15 and a diode 16 with the collector of the transistor 7. As a result, when all of the transistors 3, 7 and 13 are turned OFF, a closed loop for releasing the energy accumulated in the solenoid 2 with a predetermined time constant is formed by the resistors 12 and 15 and the diodes 10 and 16.

The operation of the solenoid driving circuit 1 of FIG. 1 will be now described with reference to FIGS. 2A to 2E. When only the level of the control voltage $V_2$ becomes high and the levels of the other control voltages $V_1$ and $V_3$ become low at the time $t_1$ (FIGS. 2A to 2C), the transistors 3 and 13 are turned OFF and only the transistor 7 is turned ON. Therefore, the current $I_c$ flows through the choke coil 6 and the level of the current $I_c$ increases in accordance with a predetermined time constant after the time $t_1$ until it reaches a steady state level.

A current I passes through the zener diode 11, the solenoid 2, the resistor 12 and the diode 16, and the level of the current I is limited by the resistors 12 and 15 to a level $L_1$ slightly lower than that at which the solenoid starts to operate (see FIG. 2E). The current at this time serves as a hold current for holding the solenoid at an energized state just before the solenoid starts to operate. The voltage $V_d$ applied to the solenoid 2 at this time has a predetermined level $V_a$ corresponding to the level $L_1$ of the holding current as shown in FIG. 2D.

Since the level of the control voltage $V_2$ becomes low and the level of the control voltage $V_1$ becomes high at time $t_2$, the transistor 3 is turned ON and at the same time the transistor 7 is turned OFF. As a result, the level of the current $I_c$ decreases in accordance with a predetermined characteristic curve, and a counterelectromotive force due to electromagnetic induction is developed across the choke coil 6. The transient voltage produced by the counterelectromotive force is supplied through the diode 10 to the solenoid coil 2, so that the magnitude of the voltage $V_d$ is increased by the addition of the transient voltage described above to the voltage $V_0$. Thus the solenoid 2 is energized.

The maximum value of the transient voltage is, however, suppressed to less than a predetermined value $V_z$, which depends upon the zener characteristic of the zener diode 11 (FIG. 2D). When the maximum level of the transient voltage is suppressed by the zener diode 11 as described above, the electromagnetic interference to other electronic equipment can be remarkably reduced and the efficiency of the circuit is increased due to the suppression of noise energy. Moreover, the width of the pulse-like voltage superposed on the voltage $V_0$ becomes wider and the leading edge of the exciting current I becomes sharper (FIG. 2E) to make it possible to operate the solenoid at high speed.

In order to reduce the level of the current flowing through the solenoid 2 below the level $L_2$ of the current I at $V_d=V_0$ for the purpose of maintaining the energized state with less current level after the solenoid 2 has once operated, the level of the control voltage $V_1$ is made to be low at time $t_3$ and at the same time the level of the control voltage $V_3$ is made to be high. Then, the transistor 3 is turned OFF and the transistor 13 is turned ON. As a result, the resistor 12 is inserted between the solenoid 2 and ground, so that the level of the current I flowing through the solenoid 2 falls below the level $L_2$ to a level $L_3$ which is sufficient for maintaining the operating condition of the solenoid.

At time $t_3$, the level of the voltage $V_d$ is lowered for an instant but it returns to the level corresponding to the level $L_3$ of the current I. In addition, as the diode 16 is provided on the side of the resistor 15 as shown in FIG. 1, the current is prevented from flowing through the choke coil 6 even when the transistor 13 is turned ON.

When the level of the control voltage $V_3$ becomes low at time $t_4$ to turn the transistor 13 OFF, the counterelectromotive force is produced across the solenoid 2. Consequently, the voltage $V_d$ once becomes negative, and after this, becomes zero level in accordance with a predetermined time constant. In this case, due to the fact that the voltage $V_d$ becomes negative, the energy accumulated in the solenoid 2 is discharged through the path of resistors 12 and 15 and the diodes 16 and 10. As a result, the level of the current I is lowered, so that it becomes possible to rapidly bring the solenoid to the OFF condition in response to the level change of the control voltage $V_3$ from high to low.

Though the output voltage from the voltage inducing circuit 8 is directly applied to the solenoid 2 in the embodiment shown in FIG. 1, as shown in broken lines in FIG. 1, a current limiting variable resistor 20 may be connected in series with the diode 10 as an attenuating means to appropriately adjust the magnitude of the exciting current I. In addition, in order to suppress the voltage produced across the solenoid 2 a variable resistor 21 may be provided in parellel with the solenoid 2 as shown in broken lines in FIG. 1.

Furthermore, although NPN type transistors are used for the current switching transistors in the embodiment described above, PNP type transistors, unipolar type transistors, or other types of semiconductor switching devices are usable instead.

We claim:

1. A circuit for driving a solenoid, which provides a suddenly standing-up exciting current to the solenoid in order to operate the solenoid at high speed, said circuit comprising:

a d.c. power source for supplying current to the solenoid;

a first switch connected in series with the solenoid for passing or cutting off the exciting current supplied to the solenoid;

a series circuit composed of a choke coil and a second switch which is switched from its ON state to its OFF state when the first switch is switched from its OFF state to its ON state, said series circuit being connected with said d.c. power source, whereby to produce a counterelectromotive force;

a unidirectional element connected between one end of the choke coil and the solenoid in order to apply to the solenoid the counterelectromotive force produced in the choke coil;

a voltage limiting element for limiting the level of the transient voltage applied through the unidirectional element to the solenoid and for applying the voltage of the d.c. power source to said solenoid coil, the voltage limiting element being connected between the solenoid and the d.c. power source;

a circuit means for providing a standby current to the solenoid when the second switch is ON; and means for providing a maintaining current with a level less than that of the exciting current to the solenoid after the solenoid is energized in response to the operation of said first switch.

2. A circuit as claimed in claim 1 wherein said voltage limiting element is a zener diode.

3. A circuit as claimed in claim 1 wherein said unidirectional element is a diode.

4. A circuit as claimed in claim 1 wherein said first and second switches are semiconductor switching means.

5. A circuit as claimed in claim 1, further comprising an attenuating means for attenuating the level of the exciting current supplied to the solenoid.

6. A circuit as claimed in claim 1 wherein said circuit means is a level limiting circuit including at least one current limiting resistor provided between the second switch and the connecting point of the solenoid and said first switch.

7. A circuit as claimed in claim 6 wherein the level limiting circuit includes at least two resistors connected in series and a switch means is connected between the connecting point of two of these resistors and ground as said means for providing a maintaining current.

8. A circuit as claimed in claim 6 wherein the level limiting circuit includes a diode for preventing the current from flowing therethrough from the side of the second switch to the side of the first switch.

9. A circuit as claimed in claim 1 wherein said standby current is set at a level slightly lower than that at which said solenoid starts to operate.

10. A circuit as claimed in claim 1 wherein said maintaining current is set at the minimum level sufficient for maintaining the operating condition of said solenoid after said solenoid has once operated.

* * * * *